United States Patent [19]

Akers

[11] 4,280,667

[45] Jul. 28, 1981

[54] WINDING METHOD AND APPARATUS AND PRODUCT THEREFROM

[75] Inventor: Richard L. Akers, Cudjoe Summerland Key, Fla.

[73] Assignee: E. I. Du Pont de Nemours and Company, Wilmington, Del.

[21] Appl. No.: 86,264

[22] Filed: Oct. 18, 1979

[51] Int. Cl.[3] ..... B65H 54/28; B65H 55/04

[52] U.S. Cl. ..... 242/43 R; 242/18.1; 242/43.2; 242/178

[58] Field of Search ..... 242/43 R, 43.2, 43.1, 242/18.1, 18 DD, 174–178

[56] References Cited

U.S. PATENT DOCUMENTS

| | | | |
|---|---|---|---|
| 1,996,864 | 4/1935 | Gladding et al. | 242/43 R |
| 2,105,140 | 1/1938 | Dersen | 242/43.2 |
| 3,606,197 | 9/1971 | Akers | 242/18.1 X |
| 3,690,579 | 9/1972 | Porter et al. | 242/43 R |
| 3,861,607 | 1/1975 | Schippers et al. | 242/43 R |
| 4,006,863 | 2/1977 | Bense | 242/18.1 |
| 4,136,836 | 1/1979 | Akers | 242/43 R |

*Primary Examiner*—Stanley N. Gilreath

[57] ABSTRACT

A cylindrical-bodied yarn package wound on a bobbin in layers of helical coils which appear in a repeating program having stable curved reversals separated circumferentially by a finite distance, substantially all the crossings occurring in the curved reversals intersect at angles greater than the angles at yarn crossings occurring in the helical portions of the yarn path. The yarn paths involve at least three cycles in which yarn is wound in a program at a constant helix angle between reversals but a plurality of helix angles are included in the program.

11 Claims, 11 Drawing Figures

WINDING METHOD AND APPARATUS AND PRODUCT THEREFROM

BACKGROUND OF THE INVENTION

This invention relates generally to yarn winding and more particularly, to winding cylindrical yarn packages with improved formation and stability. Such packages are commonly formed by windups employing a surface drive using the "print roll" or "direct" traversing techniques. A distinction should be made between "print roll" winding, and "direct" traversing. Both are commonly found in the art, but there are differences both in the application of the reversal profiles to the package and in the resulting package structure that are important to an understanding of this invention.

In "print roll" winding, a controlling traverse means generates a curved yarn reversal on the featureless cylindrical surface of the "print roll" that passively carries the yarn to the package and rolls it onto the package surface. Because only friction with the roll surface maintains the curved yarn reversal on the roll, usually the radius of the reversal must be relatively large and the helix angle of the yarn between curved yarn reversals relatively low. The large reversal radius tends to generate high shoulders on the ends of the package, which is reduced by "ironing" contact with the print roll. Because the reversal radius is large and the helix angle is low, little axial component of tension exists, and the ironing results in the excess shoulder yarn being displaced outward, forming bulged ends and increasing the package length beyond the stroke length of the reversal as carried by the print roll; therefore, with increasing package size, newly laid curved yarn reversals generally fall inside the outer limits of the package length and their stability on the package depends solely on friction with the substantially cylindrical surface of the package again requiring a relatively large reversal radius.

In the "direct" traverse method used in this invention and the invention of U.S. Pat. No. 4,136,836, the controlling element (in this case the inner shoulder of the roll groove) leads the yarn onto the package by means of tangential laydown from the roll reversal groove to the package; the yarn reversal curves so generated, that define the end of the package, called outer reversals, may be of small radius and may lead away from and into a relatively high helix angle, and, as a result, shoulder buildup and consequent ironing and package lengthening effects are minimized. Newly laid yarn is led slightly beyond the yarn reversals of the underlying layers with the result that the preponderance of these reversals tend to be "hooked" slightly over the end as may be seen by inspection of the package. This condition resembles an "overthrown end" except that the chordal length is so small as to be insignificant and harmless; however, the "hooking" contributes beneficially in that the newly laid reversal curves are to a degree mechanically constrained against sliding inward and in turn they constrain the package layers immediately below against being displaced outward by the ironing effect of the roll. In this invention, this effect is strengthened by the fact that outer reversals are of small radius and other reversals may be deposited inwardly, as will be described, substantially eliminating the shoulder that otherwise would be "ironed" outward, and additionally, the axial component of tension of the elastic yarn, acting on the "hooked" reversal, has a slight tendency to draw the layers of yarn below toward the center of the package, this insuring that subsequent reversals will continue to be "hooked." Reversals laid inboard are not so hooked and, therefore, in order to insure stability must be laid in a larger radius.

In any dual mode traverse windups employing a grooved or a partially grooved traversing roll as a second traversing device, the package may be driven or its surface speed may be controlled by direct surface contact with the grooved traversing roll which is operated at constant speed. As the yarn package increases in size its circumference increases, passing through a series of fractions of the yarn wave length (i.e., the length of one complete traverse cycle) as defined by the grooved traversing roll. During such condition as well as immediately prior to and following each such condition successive yarn waves on the package overlap or lie closely adjacent to each other producing a satiny, slippery surface known as a ribbon that is highly undesirable, particularly in the curved reversal portions where the yarn may become unstable and initiate sloughing toward the center of the package. The conditions under which the ribbons form are usually expressed as a ratio:

$$\frac{\text{package revolutions}}{\text{number of yarn waves}}$$

Typical numerical values being 3:1, 4:1, 5:2 and the like. When the terms of the ratio are low numbers the condition is more undesirable. Heretofore, in this type winding, the ribbon effects could not be avoided but only minimized by the expedient of running between package diameter limits corresponding to two consecutive low-ordered ribbons, e.g., 13:2 and 6:1; however, this imposes an intolerable limit on package size. Even in a dual mode winder in which the package being wound is not in contact with the grooved roll but is driven independently, ribbon formation could only be modified either by varying the speed of the traverse mechanism cyclically, as usually practiced, or by varying the surface speed of the package. These are feasible ways of partially avoiding formation of ribbons; however, added complexity and expense are incurred since some kind of speed changing devices and a means for programming the devices must be added. A further disadvantage is that due to rotational inertia it is difficult to effect a rapid change in speed. An alternative is to accept a slower speed change; however, it will be realized that the transitions from acceleration to deceleration and vice versa will inevitably be initiated while running in a ribbon wind condition, therefore, the speed change will not be made quickly enough to avoid ribbons completely or modify them significantly; thus, at times this type of ribbon breaking is ineffective for its intended purpose. This is particularly true as winding speeds are increased since the energy required increases as the square of the speed.

SUMMARY OF THE INVENTION

To overcome the above shortcomings a novel highly stable cylindrical-bodied yarn package structure is produced by placing various curved yarn reversals in different locations on the yarn package to effect a discrete separation between reversals. The yarn package of this invention is characterized by a novel structure in which the yarn in quasi-ribbon layers of helical coils, appears in a repeating program having stable, curved reversals separated circumferentially by a finite distance wherein substantially all yarn crossings occurring in the curved reversals intersect at angles greater than the angles at yarn crossings occurring in the helical portions. These angles appearing at the crossings of the curved reversals are 2.5 degrees or larger. The package is further characterized in that any helical yarn path beetween successive reversals is at a constant angle but the package has a plurality of different helix angles and may have different radii in the reversals, and that the half-stroke length of at least 50% of reversals are of substantially equal length and a minority of the reversals are of any other single half-stroke length. Using a novel dual-mode traversing apparatus, the winding of the package of this invention employs the novel steps of effecting the transfer of a plurality of different yarn waves to a package in a program of at least three cycles in which yarn is wound at a constant helix angle between reversals but successive helix angles may be different. Therefore, during the growth of a package, under winding conditions in which a single cycle traverse would ordinarily produce a ribbon, the method of the present invention produces a "quasi-ribbon" in which successive yarn wraps are not contiguous. The program is repeated to form successive layers of yarn on the package.

DETAILED DESCRIPTION OF THE ILLUSTRATED EMBODIMENT

This relates to an application by R. L. Akers filed Dec. 16, 1977, application Ser. No. 861,306, now U.S. Pat. No. 4,136,836 which covers an apparatus and a method of winding yarn using a shouldered traverse roll useful in the present invention and which is incorporated herein by reference.

Figure 1:
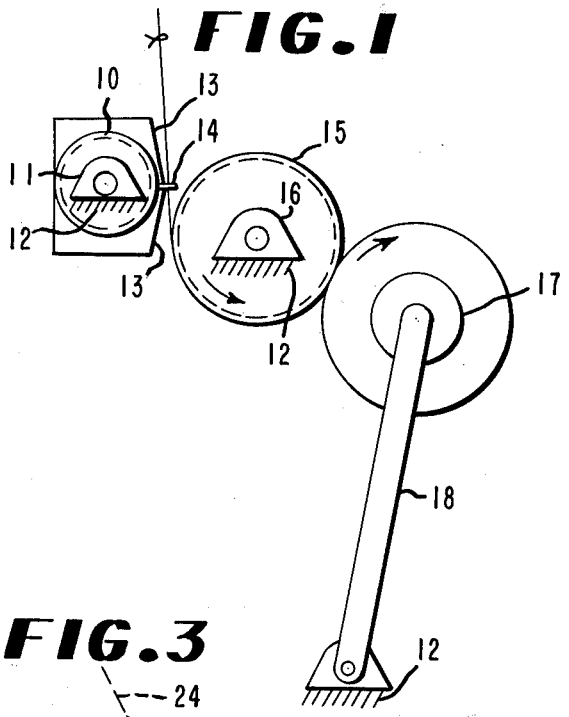
FIG. 1 is a diagrammatic end-elevational view of a type of winding apparatus in which the present invention is useful.
Figure 2:
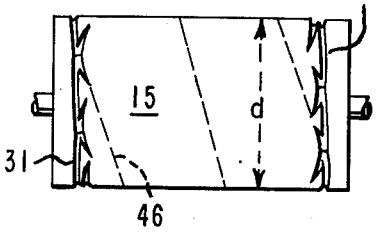
FIG. 2 is a side elevational view of the traverse roll of FIG. 1.

Referring to FIGS. 1 and 2, a typical winder to which the present invention is applicable includes a barrel-type traverse cam 10 having a generally helical "endless" groove (not shown) mounted in fixed bearings 11 secured to a machine frame 12 and being generally adapted to drive a cam follower-yarn guide 14 between a pair of fixed rails 13. Immediately in front of the traverse mechanism is A generally cylindrical shouldered traversing roll 15, portions of which are described in greater detail below, that is also mounted in bearings 16 on machine frame 12. The traverse cam 10 and the traversing roll 15 are adapted to be power-driven in a specified relationship (to be described) by means of, for example, toothed timing belts (not shown) running to a common motor (not shown). Beneath the roll 15 and in driven contact therewith, initially, is a bobbin or tube 17 mounted on a suitable chuck on bearings (neither shown) which are carried by a swing arm 18 which, in turn, is pivotally mounted on machine frame 12 so as to permit the tube or yarn package to be urged into contact with the roll 15 throughout a winding period, e.g., by means of a spring (not shown). If desired, the package may be driven independently and separated, slightly, from contact with roll 15. It is also contemplated that additional bobbins 17 and swing arms 18 (not shown) may be spaced circumferentially around roll 15 in which case additional yarn lines will pass through guide 14 and around roll 15 to their respective bobbins.

Programs, General

Figure 4:
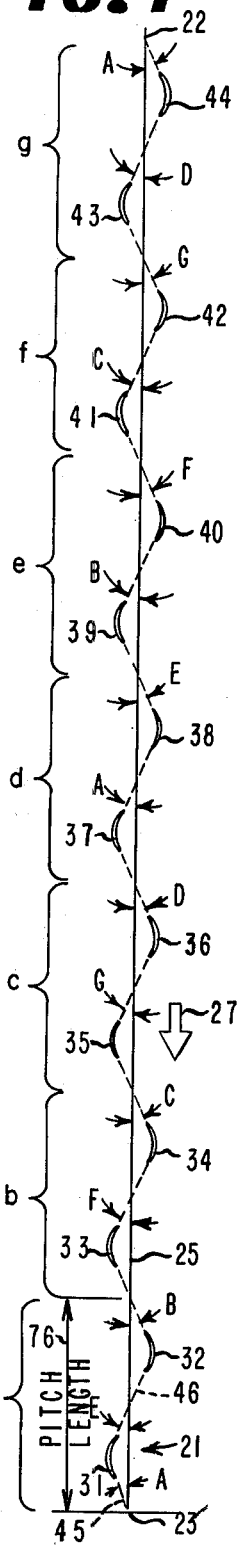
FIG. 4 is a diagrammatic example of a traverse roll having seven cycles showing all of the cycles appearing in sequence in successive developed views of the roll surface.

In the present invention use is made of a plurality of different traverse cycles in a program in which one or two or all three of the parameters of helix angle, half-stroke and reversal radius are varied from cycle-to-cyle as further described below. The various cycles are incorporated into a single shouldered roll 15. If the surface of such a roll is developed repetitively, it will appear as shown in FIG. 4 in which the length of the diagram measured vertically represents the circumference of the roll 15 repeated a sufficient number of times to depict all of the traverse cycles arranged sequentially. Successive cycles appear in this view as a series of reversals (solid lines) connected by alternating helical paths (broken lines) and FIG. 4 is an example of a seven-cycle program in a traverse roll surface. Since the cycles must form an "endless" progression an integral number must be used while the entire program of cycles must be capable of being "wrapped" about the roll 15 an integral number of times, thus the trailing end 22 of the last half-cycle must match or be aligned with the leading end 23 of the first half-cycle 21 in terms of stroke position, helix angle and hand (LH or RH). In addition to integral numbers of traverse cycles and roll wraps, other criteria must be met as will be described.

Figure 3:
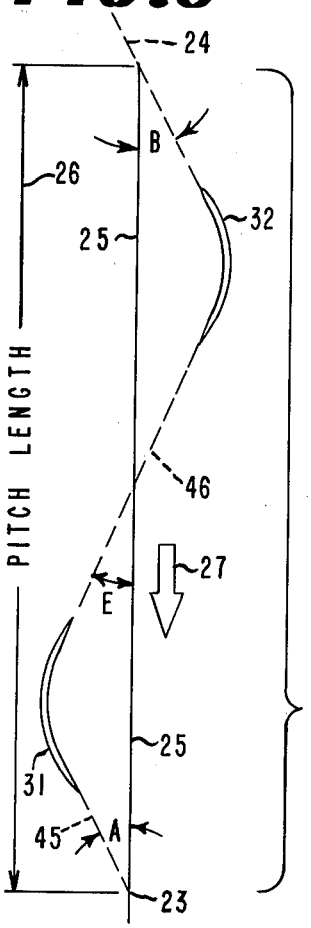
FIG. 3 is a diagrammatic, partial development of a traverse roll surface showing a single traverse cycle.

In the diagrams of FIGS. 2 and 4, the curved solid lines (e.g., 31,32) represent shouldered grooves or reversals in the roll 15, as described more fully in U.S. Pat. No. 4,136,836, while the broken lines (which are straight lines) represent the helical paths (e.g. 45,46)

taken by yarn between reversals. The lower end of the diagram of FIG. 4, called the leading end, is the first to contact the package and to effect the traversing of yarn, thus, arrow 27 designates the direction of motion of the roll surface. The upper end is called the trailing end. FIG. 3 is similar to FIG. 4 except that it is to a larger scale to show details and it only depicts a single cycle 21. For convenience, cycles are considered to originate from a common midpoint taken half-way between the extremes of the package length; this is illustrated in FIGS. 3 and 4 by line 25 which represents the midpoint. For purposes of definition, in any single cycle the distance between the point of intersection of a helical line 24 with the midpoint (on line 25) and the next point of intersection of a helix of the same hand with line 25, measured circumferentially, is called the pitch of the cycle as denoted by line 26; this may also be called the wavelength. A half-stroke is defined as the axial distance between line 25 and the peak of any given reversal.

It will be understood that the traverse cam 10 that is synchronized with roll 15 will have a continuous track having a program which correlates to that of the shouldered roll 15 to insure that yarn traversed by guide 14 is suitably led onto roll 15 in the manner described in U.S. Pat. No. 4,136,836 and also described further, below.

Programs, Symmetry

A desirable characteristic in a traversing program is symmetry by which is meant that for the three parameters of helix angle, half-stroke, and reversal radius, a like number and preferably a like sequence of each dimensional value, high, low and intermediate should be "balanced" from the left side of the program to the right or on opposite sides of line 25. This is desirable in that each of these three parameters is a determinant of the quantity of yarn per unit axial length placed in a package, the distribution of the yarn and its tension history; thus, if substantial differences are present from left to right in any of the three parameters, then the diameter of the package and/or its shoulder profile may be different from end to end which is an undesirable situation. While even numbers of cycles can be used, odd numbers of cycles are preferred, (e.g. 3, 5, 7, 9, 11 and the like) since if the magnitude and sequence of helix angle, half-stroke, and reversal radii defined in the first one-half of the program are repeated in the second half of the program in the same order, the hands of all helices are reversed and symmetry is assured. In a program comprising an even number of cycles, symmetry can be approximated by having each helix angle present in both left and right hand sides and the values and relationships of half-strokes and reversal radii matched at both ends. However, the pattern of the quasi-ribbon will be different at each end and each end must then be examined for avoidance of contiguities, as will be described.

Half-stroke Lengths

Referring first to half-stroke length, in winding yarn to a cylindrical package it is well known that the reduced traverse velocity in any reversal, compared to the constant velocity of traverse of the helical portions, causes shoulder buildup or raised bands at each end of the package. This effect may be substantially reduced by the use of a number of different half-stroke lengths. It has been found desirable to provide at least 50% and preferably 70% to 80% outer reversals tangent to the edge of the package with the remaining reversals distributed such that a minority of reversals are placed at any one location. This is necessary to avoid excessive buildup of yarn in the zones occupied by the reversals other than outer reversals. This excessive buildup results from two causes: (a) the zones occupied by reversals inboard of the end of the package contain additional yarn leading toward and away from all reversals that lie farther out; (b) because reversals inboard of the ends are not as stable as outer reversals, they usually must be of larger radius and thus add more yarn to the zones they occupy. It is preferred in the present invention to use three different half-stroke lengths designated as "outer" (longest), "inner" (shortest) and "middle." In establishing actual half-stroke lengths, it is preferred that the peak of the arcuate portion of any reduced-stroke reversal (say a "middle" one) be located on the yarn package axially inside the arcuate portion of an "outer" reversal or in other words preferably in juxtaposition with the helical portions leading to the outer reversal. The axial height H of an arcuate reversal may be calculated from:

$$H = R - R \cos h \qquad (1)$$

where:

R=Radius of the reversal h=The maximum helix angle leading to the reversal

Thus, to determine the half-stroke of the "middle" reversal, the calculated axial height H is subtracted from the half-stroke of the "outer" reversal; a typical value for axial height H is about 0.2 cm or more depending on reversal radius and helix angle. Similarly, "inner" half-strokes may be shortened, relative to the "middle" ones. It will be understood that the sum of the two largest half-stroke lengths on the traverse roll will slightly exceed the desired package length at the point of yarn laydown on the package. This is due to uncontrolled yarn length effect discussed more fully in U.S. Pat. No. 4,136,836.

Another consideration relating to half-stroke length is that package beveling is to be avoided. If proportionately too few outer strokes are used, the excessive buildup of the inner reversals will cause the ends of the package to be beveled showing a slightly smaller diameter at the package ends which means that the instant portion of yarn outermost on the package (i.e., the curving reversal) will not be in contact with the drive roll; furthermore, the uncontrolled yarn length will be increased. This beveling, then, brings about two undesirable conditions: (a) the increased length of uncontrolled yarn causes an increase in the radius of the reversal curvature and at the same time renders it less precise and less repeatable (which may result in "overthrown ends," i.e., yarn laid chordally across the end of the package); and (b) the local loss of "ironing" by the drive roll reduces the stability of the reversal and it may, therefore, slide axially inward on the package. These conditions are avoided in the present invention.

Reversal Radii

It is desirable that the radii of all reversals be the minimum values that will have stability. That of the middle and inner reversals, which lie on a substantially cylindrical surface, will depend on factors affecting the friction of the yarn on the package such as type of yarn, cross-section of the filaments, and yarn finish, as well as winding tension, maximum diameter of the package, speed (and the concomitant centrifugal force) and the like. A radius of about 20 cm has proved to be suitable (for middle and inner), e.g., for partially oriented polyester yarn of 150 to 220 denier with 34 filaments of round cross-section and a relatively low-friction finish. The radius of the outer reversals may be smaller, as has been described and is normally limited by mechanical considerations as described in U.S. Pat. No. 4,136,836. Radii of about 10 cm have been used sucessfully with the same yarn (as above), but 15 cm has proved sufficiently small and results in less severe conditions with respect to the first traverse device 10 and deposition of yarn thereby onto the shouldered roll 15. The sequence of outer, middle, and inner reversals within the program of helix angles is arbitrary but it will be found that some arrangements may be more favorable than others with respect to the ultimate relationships of the reversals to the yarn pattern, the roll pattern, or the traverse cam pattern (as described further).

Helix Angles

The helix angle is the instant angle that the yarn makes relative to a plane at right angles to the package axis of revolution which in the developed view of a traverse roll, FIG. 4, is represented by the angles designated by the letters A to G. In the selection of dimensional values for helix angles and their sequence, two considerations apply, namely, avoidance of interferences between grooves in a traverse roll (and in a traverse cam) and avoidance of ribbon-like yarn contiguities in a package. In FIG. 4, each helical path, e.g., 46, that merges with and joins successive shouldered reversal grooves 31,32, has a constant helix angle, in this instance, E. Preferably, successive helical paths 45,46 are at different helix angles A and E, respectively. If desired, the helix angles of alternate strokes may have values which progress discontinuously above and below the average helix angle for the program as exemplified below; this will minimize the length of yarn wound at successive different speeds, winding speed being equal to the circumferential speed of the yarn package divided by the cosine of the instant helix angle. It will be recognized that this offers an advantage over prior art practices in which cumulative tension changes may be excessive due to the relatively long-term continuous changes in helix angle in each direction experienced in conventional ribbon-breaking. Other helix angle sequences may be chosen to provide a greater separation of the reversals, at the expense of somewhat longer continuous lengths of yarn wound at above average and below average helix angles; this may be preferred for some yarns.

In designing the traverse roll, an average helix angle is selected for a program and maximum deviations above and below the average angle are also selected, then, depending on the number of cycles to be used in the program, substantially equal angular increments are used initially to approximate the size of the several helix angles between the maximum and the minimum. As a guide to maximum-minimum helix angle variation, in conventional ribbon-breaking practice a cyclic variation of ±4% in helix angle is known to be effective; although the present invention does not use conventional practices, it has been found that a similar spread of ±4% is acceptable for packages about 24 cm in length; plus or minus about 6% may be used for packages of about 12 cm in length or, in other words, for shorter packages a greater variation in helix angles is not only acceptable but is sometimes necessary in order to achieve the desired degree of circumferential separation of reversals in quasi-ribbon winding. Thus, helix angle variation has, approximately, an inverse relationship to package length. Thus, if the average helix angle is about 9.5°, a tabulation of values of angles that could be used as follows:

TABLE I

| Angle Identity | Helix Angles, Degrees |
|---|---|
| A | 9.848 (Max) |
| B | 9.722 |
| C | 9.595 |
| D | 9.469 |
| E | 9.343 |
| F | 9.216 |
| G | 9.090 (Min) |

From this tabulation, it may be seen that the angle D, the average of the maximum and minimum (which is also the average value for the program) is 9.469° and that the maximum deviation is ±0.379° or $\pm(0.379/9.469)\times 100=\pm 4.0\%$. The values of Table I are subject to later adjustment, as described below. Following the general considerations relating to helix angles, as noted above, the sequence of helix angles for the successive cycles is chosen, for example,

| Left Hand | Right Hand |
|---|---|
| A | E |
| B | F |
| C | G |
| D | A |
| E | B |
| F | C |
| G | D |

These are shown in FIG. 4 as angular dimensions on helix angles and are shown in this sequence.

Traverse Roll Design

When a tentative selection of parameters and values have been made for the principal variables, as noted above, and additional limiting dimensions are known (e.g., the limits relating to the winding apparatus on which the traverse roll is to be used) then the following items will be known:

Cycles in program
Revolutions per program
Traverse roll diameter
Package length
Half-stroke lengths
Table of helix angles
Reversal radii
Sequence (for varying parameters)

With this information, it is possible to calculate cycle pitch lengths and consequently program length using conventional geometric and trigonometric methods. If at this stage the program length is not such as to make an integral number of wraps in the traverse roll, then tentative adjustments may be made on roll diameter or in cycle pitch lengths (which will, of course, affect helix angles) to conform roll to program or vice versa. When it appears that a satisfactory arrangement has been achieved, further tests are applied as described below.

Reversal Separations

Figure 7:
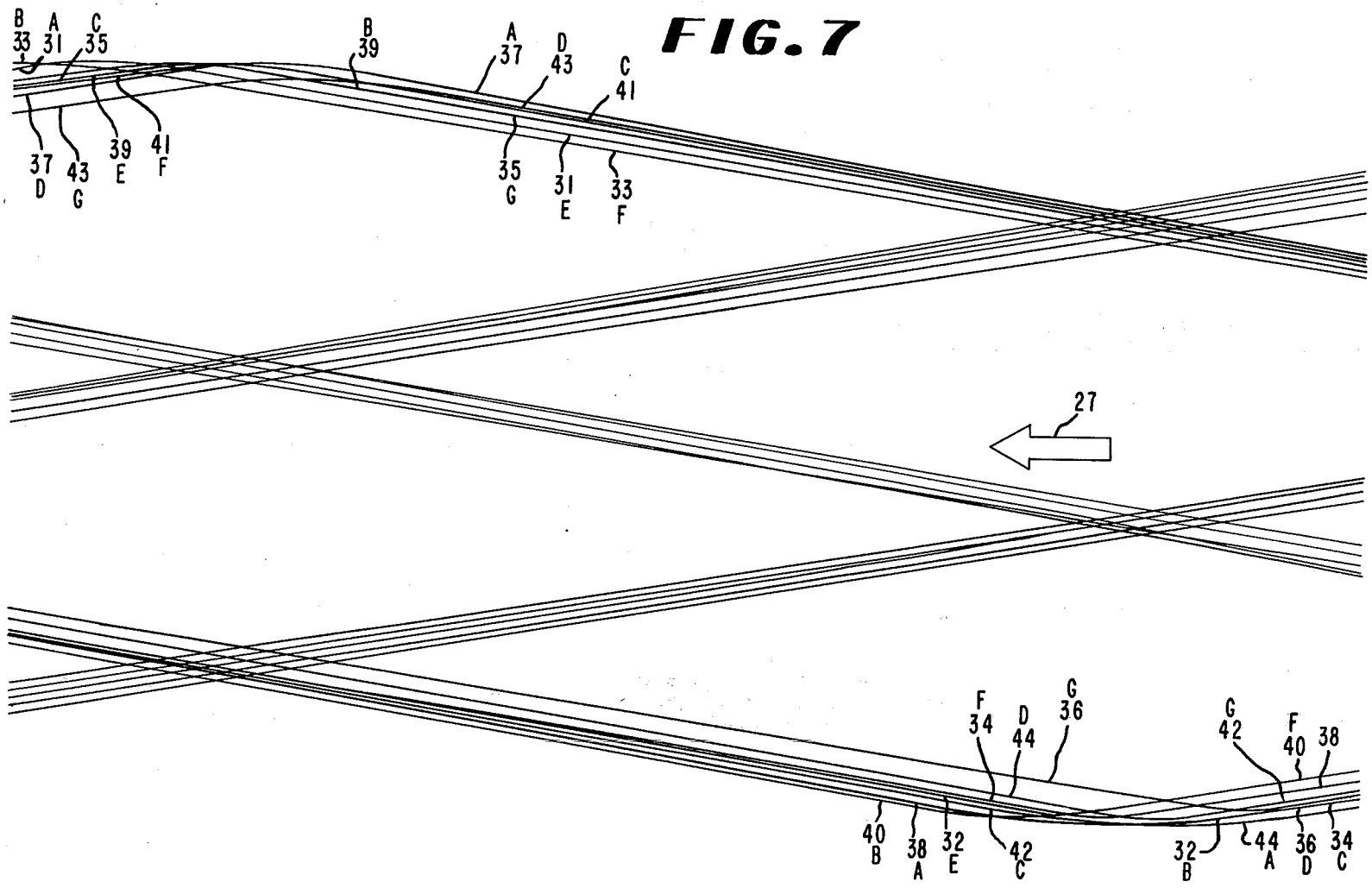
FIG. 7 is a plot of a plurality of yarn paths as they would appear on the developed surface of a yarn package of this invention of such size as to be in a quasi-ribbon condition of winding and showing separation of successive yarn wraps.

As noted heretofore, an object of the present invention is to wind a superior yarn package with improved stability particularly in quasi-ribbon conditions of winding. In general, according to this invention, this object is met in part by a unique separation of successive layers of yarn lines in the quasi-ribbon condition, particularly in and near the reversals which yarns would otherwise be contiguous with each other. Thus, in preparing a plural-cycle traverse roll, the dimensional parameters that have been selected tentatively must be examined; this is best carried out by preparing a scale drawing of successive yarn reversals as they would be laid down in a quasi-ribbon condition. This condition will exist when:

$$\text{Package circumference} = \frac{\text{Length of program of plural cycles}}{(N_2)\ (\text{Number of cycles in program})} \quad (2)$$

where $N_2$ is a whole number, e.g., 1, 2, 3, 4, 5, and the like. The length of the program for the embodiment being described is 20.935 m and the number of cycles is 7. A 5:1 quasi-ribbon condition is convenient; referring to Equation 2, $N_2$ may be taken to be 5, thus:

$$\text{Package circumference} = \frac{20.93\ M}{5 \times 7} = 0.598\ m,$$

or 0.598 m is the actual length of the scale diagram. Such a diagram is preferably made full-scale or larger and is prepared by dividing the program into parts of equal length according to package circumference at the preselected quasi-ribbon condition, in this case 0.598 m; the several parts, in effect, are then superimposed on each other sequentially by drawing individual lines to represent the yarn paths of the entire program in true scale relationship. An entire diagram is shown in FIG. 7, at about half scale due to space limitations and is shown fragmentarily at about full scale in FIG. 11; the latter shows plural reversal portions at one end of the traverse stroke to show separations and angles between yarn lines more clearly. With scale diagrams of this type it will become apparent immediately if undesired contiguities exist particularly in the reversal regions in which case adjustments may be made in helix angle, half-stroke or reversal radius to avoid the contiguities. It should be noted that any integral value for $N_2$ will produce the same pattern at reversals; therefore, only one such diagram is needed for a given program of cycles.

Figure 9:
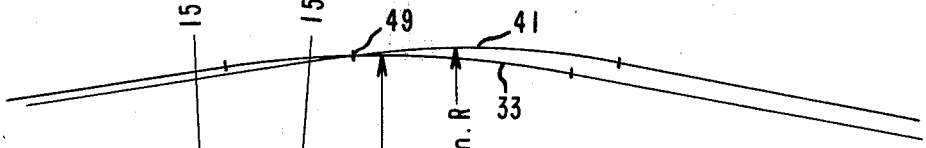
FIG. 9 is similar to FIG. 8 except that it shows reversals of unlike radii with acceptable separation between yarns according to this invention.
Figure 10:
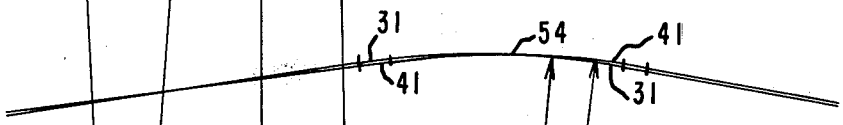
FIG. 10 is a diagrammatic developed view of a pair of intersecting or crossing yarn reversals, having like radii, showing unacceptable separation between the yarns.
Figure 10:
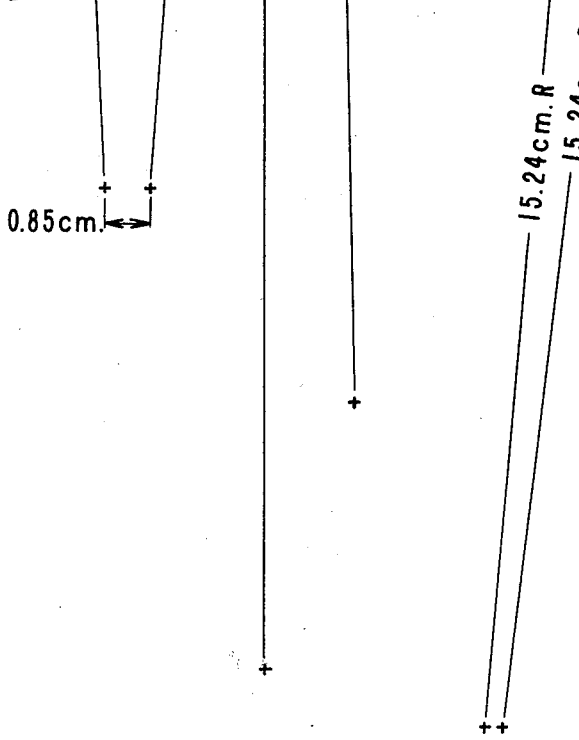

It will be recognized that a package of the same circumference as that of FIG. 7 but produced by a constant speed traverse device having only a single cycle with a wave length equal to the average of the wave lengths in FIG. 7 will be in a true ribbon condition and, for such a package, diagrams similar to FIG. 7 would show all yarn reversals superimposed and contiguous. One novel feature of the present invention, when winding in quasi-ribbon condition, is separation of yarn reversals which will be described and defined in terms of yarn spacing and angles between yarn lines in the crossings found in the reversals. This is done with the aid of drawings, FIGS. 8, 9 and 10 of which FIGS. 8 and 9 show acceptable yarn relationships in reversals in quasi-ribbon conditions while FIG. 10 shows an unacceptable relationship; the latter is characteristic of the prior art in situations in which ribbon winding is experienced.

Figure 5:
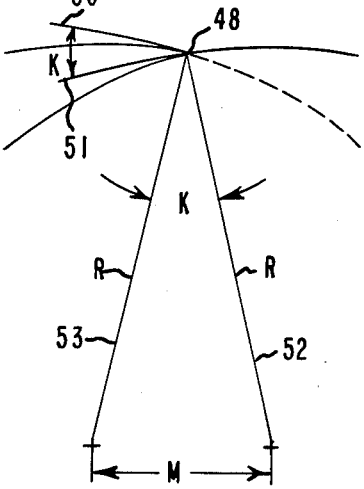
FIG. 5 is a geometric diagram showing an angle of intersection between two curves; the size of the angle is exaggerated.
Figure 8:
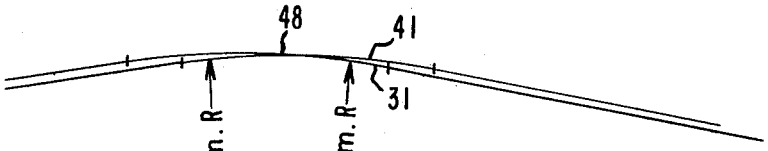
FIG. 8 is a diagrammatic developed view of a pair of intersecting or crossing yarn reversal curves, having like radii, showing acceptable angle and separation between the yarns according to this invention.

Referring to FIG. 8, a pair of reversals 31,41 having like half-strokes and like radii are shown (with portions of their associated helices) to occupy distinctly different paths, i.e., are separated by 0.1 cm or more, thus are not being laid down in contiguity as in a prior art ribbon, and furthermore, that they cross one another at a relatively large angle at point 48 which crossing occurs in the arcuate parts of the reversal. Referring to FIG. 5 which is exaggerated for a better showing, if tangents 50,51 are drawn to the respective curves at the point 48 of intersection as illustrated diagrammatically, when the angle K is the angle at which the curves intersect; this may be determined by drawing radial lines 52,53 from the point of intersection 48 to the respective centers used for drawing the arcuate reversals of radius R; since the distance M between the centers is known, the angle K may be determined, i.e., $\sin K = M/R$ ® or in the preferred embodiment of FIG. 8:

$\sin K = 0.85\ \text{cm}/15.24\ \text{cm} = 0.558$ and $K = 3.2°$

Thus, according to the present invention, by definition, when winding in a quasi-ribbon condition all yarn intersections occurring in the arcuate reversals will be at an angle of 2.5° or more; stated differently, all such crossings occurring at 2.5° or more will result in sufficient yarn line separation elsewhere to avoid ribbon types of contiguities. Thus, in the curved reversals, the crossing angles are appreciably larger than elsewhere; e.g., referring to the purely helical lines, the maximum difference in helix angles may be seen to be about 1°, or less.

This introduces a slight error but it is negligibly small for small angles.

For the purpose of the present invention, contiguity is defined to mean actual line-to-line contact between adjacent strands of yarn or contiguity may be considered to be present if adjacent yarn lines are only separated by a distance equal to or less than the cross-sectional diameter of the bundle of filaments comprising the yarn, or alternatively, the transverse dimension of a flattened filament bundle when it is lying across a supporting surface. Where yarn crossings occur in the curving reversals, contiguity is considered to be avoided if the angle of intersection is 2.5° or larger. In FIG. 9 are shown another set of reversals 41,33 of unlike half-stroke and unlike radii which have arcuate portions that intersect at point 49 where tangents (not shown) drawn to the respective arcs have an included angle greater than 2.5°; by inspection, it may be seen that at all other regions in and around the arcuate reversals the yarn lines are separated significantly, e.g., are not contiguous.

Figure 6:
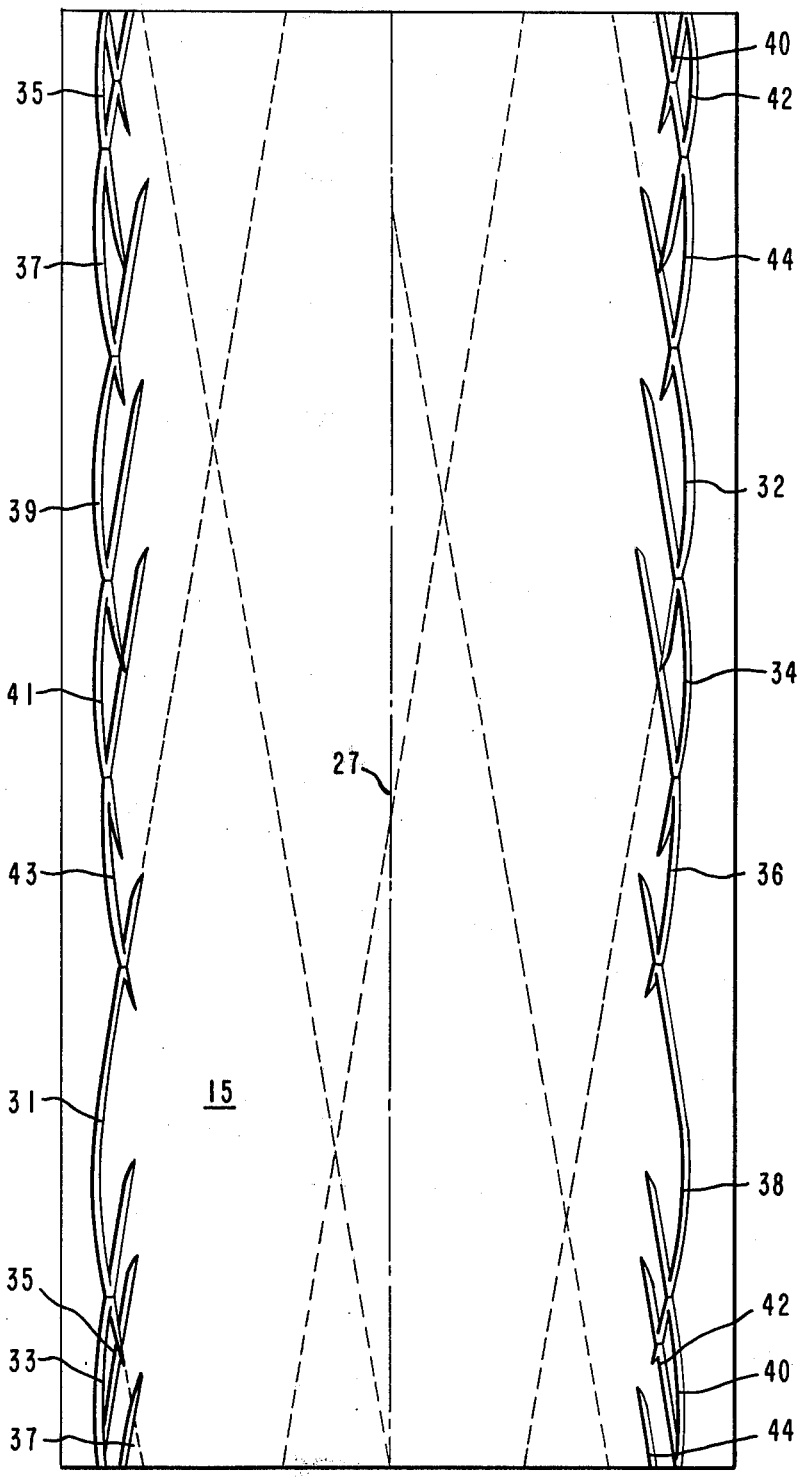
FIG. 6 is a developed view of the circumference of the traverse roll of FIG. 2 showing shouldered grooves machined into its surface.

In contrast, referring to FIG. 10, an undesirable type of intersection between two arcuate reversals 31,41 of like radii and like stroke intersect at point 54 at an angle of 1.3° between tangents; by inspection, portions of the reversals may be seen to be effectively contiguous. Another type of unacceptable relationship between yarn lines when winding in ribbon-like conditions occurs when arcuate reversals run sufficiently close to each other (not shown) as to become tangent or substantially tangent, that is within the definition of contiguity, above. Returning to the scale drawing FIG. 7, if undesired conditions appear as defined herein, such as yarn crossings in the reversal arcs of less than 2.5° included angle, arcuate tangencies, contiguities and the like, then the dimensions of helix angles and the positions of the various half-strokes and reversal radii in the program may have to be altered, collectively or individually to eliminate the undesired conditions. However, before this is done, another test should be applied, i.e., to make a scale drawing similar to FIG. 6 depicting a single roll circumference which represents a developed diagram of the surface of the traverse roll 15 inclusive of shouldered reversal grooves (e.g., 31,32 and the like). In such a diagram, the successive cycles are, in effect, wrapped about the roll a plurality of times to effect a complete program, it being realized that the program must make precisely an integral number of wraps so as to meet end-to-end at the leading and trailing portions. This will expose any groove-to-groove interferences by which is meant that the grooves may intersect but preferably do so outside the curved reversal portion of the shouldered groove, i.e, at a location where it is substantially impossible for yarn to "switch" grooves. As to the groove intersections, if these occur at a relatively large angle (e.g., about 15° or more) the yarn will be unlikely to migrate for any appreciable distance into a wrong groove or will be unlikely to be inhibited from sliding into contact with the groove shoulder, as it should. If undesirable conditions require that adjustments be made, it will be realized that changes, as above, demand compensatory changes (e.g., in helix or in the program as a whole) so that the requirement of integral wraps about the roll is met. Further, a given helix angle should not be changed to the degree that it coincides or nearly coincides with another helix angle in the program; if such extreme measures appear to be required, a shift of the middle and/or inner reversals to different locations in the series of helix angles may produce a more favorable condition.

A preferred embodiment (e.g., for partially oriented polyester yarn) for traverse roll 15 is based on the following:

TABLE II

| | |
|---|---|
| Cycles in program | 7 |
| Traverse roll diameter | 19.62 cm |
| Package length | 24.13 cm |
| Average helix angle | 9.47° |
| Revolutions per program | 34 |

Using these dimensions, a program such as that diagrammed in FIG. 4 is $34 \times 19.62$ cm $\times \pi = 20.935$ m long, measured circumferentially on roll 15 while the pitch of each cycle varies somewhat from 1/7th of this length since the cycles are different. The dimensions for the cycles of this program are tabulated in Table III; the letter and number designations are used as reference characters in FIGS. 4 and 7.

TABLE III

| Cycle | Reversal No. | Reversal Rad., cm | ½-Stroke cm | Helix Angle | Helix Angle, degrees |
|---|---|---|---|---|---|
| a | 31 | 15.24 | 12.35 | A | 9.843 |
| | 32 | 15.24 | 12.35 | E | 9.371 |
| b | 33 | 20.32 | 12.16 | B | 9.737 |
| | 34 | 15.24 | 12.35 | F | 9.186 |
| c | 35 | 15.24 | 12.35 | C | 9.629 |
| | 36 | 20.32 | 11.88 | G | 9.095 |
| d | 37 | 15.24 | 12.35 | D | 9.469 |
| | 38 | 15.24 | 12.35 | A | 9.843 |
| e | 39 | 15.24 | 12.35 | E | 9.371 |
| | 40 | 20.32 | 12.16 | B | 9.737 |
| f | 41 | 15.24 | 12.35 | F | 9.186 |
| | 42 | 15.24 | 12.35 | C | 9.629 |
| g | 43 | 20.32 | 11.88 | G | 9.095 |
| | 44 | 15.24 | 12.35 | D | 9.469 |

These dimensions are used to produce or machine a shouldered traverse roll having grooves as disclosed and claimed in U.S. Pat. No. 4,136,836 but with plural cycles as depicted in the developed view, FIG. 6, or the elevational view, FIG. 2, which roll is then useful for winding yarn generally by the method of U.S. Pat. No. 4,136,836.

Traverse Cam

The traverse cam used in association with the shouldered roll of Tables II and III must also have seven cycles. It may be of any convenient diameter and its cam track may have any suitable range of pressure angles; however, since the helical portions of the traverse cam track may have pressure angles much greater in magnitude than the helix angles of the grooved roll, the cam may have its seven cycles spread over a smaller integral number of revolutions. As in the case of the roll, the number must be a nonintegral multiple of the number of cycles (or any factor of the number of cycles if this number is not a prime) to avoid whole or partial superimposition of reversals in the track. Thus, in the seven cycle traverse cam 6, 8 or 9 revolutions could be used any of which would assure that the circumferential space available for each reversal is about 1/7 of the cam circumference (varying, of course, by the circumferential displacements from the average that are characteristic of the invention). In conjunction with the preferred embodiment cited in Tables II and III, the total circumferential length resulting from six revolutions would have produced an impractically high cam pressure angle; that resulting from nine revolutions would expand the circumferential space occupied by the reversals resulting in the occurrence of crossings in the curved portions, which is undesirable; eight revolutions avoided these concerns and was selected. Since the shouldered roll completes its seven cycles in 34 revolutions, the drive ratio from the roll to the cam is $34/8 = 4.25:1$ for the proper synchronization of the drives. In the selection of cam pressure angles, the following expression is of use:

$$\tan^{-1} p = \frac{\tan h \times D_r \times R_r}{D_c \times R_c} \quad (3)$$

where:

p = pressure angle of cam h = helix angle of the segment of the yarn program corresponding to the instant pressure angle $D_r$ = diameter of shouldered roll 15

$D_c$ = diameterof cam barrel 10

$R_r$ = number of revolutions in the program of roll 15

$R_c$ = number of revolutions in the corresponding cam program

Another example of the shouldered roll 15 of this invention has the following characteristics:

TABLE IV

| | |
|---|---|
| Cycles in program | 7 |
| Traverse roll diameter | 19.62 cm |
| Average helix angle | 9.46° |
| Revolutions per program | 17 |

TABLE V

| Shouldered Roll | | | |
|---|---|---|---|
| Cycle | Reversal Radius, cm | ½-Stroke, cm | Helix Angle, degrees |
| 1 | 15.24 | 6.0 | 8.924 |
| | 20.32 | 5.63 | 9.705 |
| 2 | 15.24 | 6.10 | 9.096 |
| | 15.24 | 6.10 | 9.852 |
| 3 | 20.32 | 5.91 | 9.285 |
| | 15.24 | 6.10 | 10.042 |
| 4 | 15.24 | 6.10 | 9.435 |
| | 15.24 | 6.10 | 8.924 |

TABLE V-continued

| Cycle | Shouldered Roll Reversal Radius, cm | ½-Stroke, cm | Helix Angle, degrees |
|---|---|---|---|
| 5 | 20.32 | 5.63 | 9.705 |
| | 15.24 | 6.10 | 9.096 |
| 6 | 15.24 | 6.10 | 9.852 |
| | 20.32 | 5.91 | 9.285 |
| 7 | 15.24 | 6.10 | 10.042 |
| | 15.24 | 6.10 | 9.435 |

Figure 11:
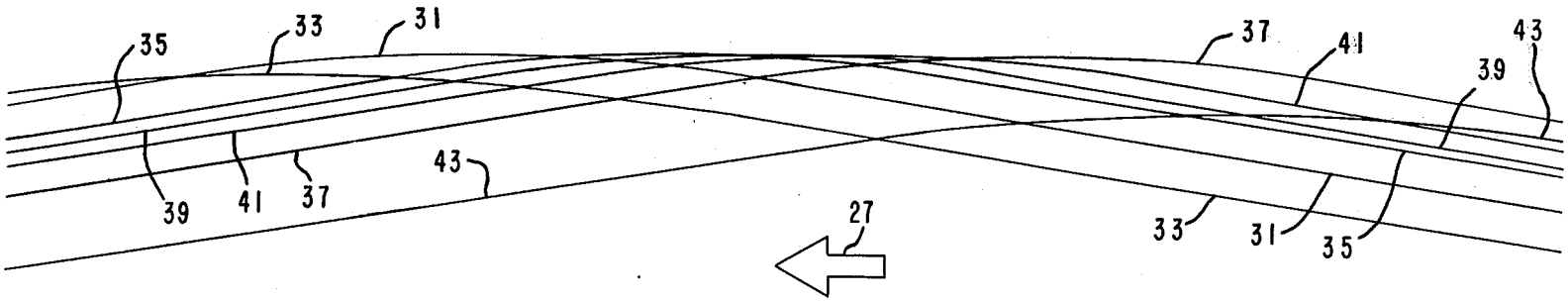
FIG. 11 is a view of a portion of the yarn path plot of FIG. 7, under the same winding conditions, showing plural reversal portions at one end of the traverse stroke enlarged to show separations and angles between yarn lines.

An alternate procedure in designing a traverse roll according to the present invention is to select numerical values for number of cycles, reversal radii, half-strokes and average helix angle generally as described herein and to make scale diagrams similar to FIG. 7 and FIG. 11 in which lines representing yarn in the reversals are laid out in a circumferentially-spaced noncontiguous pattern, representative of a quasi-ribbon condition, after which the several reversal curves are joined by tangential straight lines representing helical lines. The helical lines may be scaled for determining helix angles but preferably are analyzed using well known trigonometric methods to determine the values of all the helix angles with precision, i.e., to about the nearest hundredth of a degree; then values are tabulated and examined for conformity to the requirements as defined herein, such as ± spread, avoidance of duplication of angle of the same hand, symmetry and the like. If it is found that any of the desired criteria of the present invention have not been met, then adjustments may be made in individual circumferential reversal position, reversal radii, half-stroke and the like (while still maintaining a noncontiguous pattern) after which the values of the helix angle may be examined again for conformity to the requirements of this invention. When a satisfactory yarn pattern is obtained a traverse roll and traverse cam may be designed as described herein.

We claim:

1. A cylindrical-bodied yarn package wound on a bobbin in layers of helical coils having helix angles formed by successive strokes, each of said coils having curved reversals connected by helical portions, there being a repeating program comprising a series of at least three of said curved reversals, said program appearing at intervals throughout the package as quasi-ribbon conditions wherein said curved reversals in the series are separated circumferentially by a finite distance from each other such that substantially all yarn crossings occurring in the curved reversals of one series intersect at angles greater than the angles at yarn crossings occurring in the helical portions, at least 50% of said reversals having substantially equal outer half-stroke lengths and a minority of said reversals having any other single reduced half-stroke length.

2. The yarn package as defined in claim 1, wherein yarn crossings occurring in the curved reversals intersect at angles of at least 2.5°.

3. The package as defined in claim 1, wherein a helical portion between successive curved reversals is at a constant angle.

4. The package as defined in claim 1, some of said curved reversal portions having different radii.

5. The package as defined in claim 1, said helical portions occurring in a plurality of helix angles.

6. The package as defined in claim 5, in which said helix angles of at least a pair of successive strokes progress discontinuously.

7. In a method for winding yarn on a bobbin into a cylindrical-bodied yarn package including the steps of rotating the bobbin to wind the yarn thereon and traversing the yarn axially through successive stroke lengths to form a package of layers of helical coils having helix angles and being laid down in their reversals in curves, connected by helical portions, the improvement comprising the step of traversing the yarn on the package in a program of at least three cycles wherein yarn is wound at a constant helix angle between reversals, said helical portions occurring in a plurality of helix angles wherein successive curved reversals are not contiguous when in a quasi-ribbon condition.

8. In a yarn winding apparatus for winding generally cylindrical cross-wound yarn in reciprocating strokes, said apparatus including a first traverse device having a reciprocable yarn guide for guiding the yarn over the midrange of the strokes and a second traverse device embodying a rotatable driven cylindrical roller having a plurality of grooves for guiding the yarn at respective ends of the strokes to impart stroke reversal to the yarn guided therein, said grooves having successive helical, reversal curve and helical portions in the surface of the roller, the improvement of which comprises: at least 50% of said reversal curve portions having substantially equal outer half-stroke lengths and a minority of said reversal curve portions having any other single reduced half-stroke length.

9. The apparatus as defined in claim 8, wherein about 60 to about 80% of said reversal curve portions have substantially equal outer half-stroke lengths.

10. In a yarn winding apparatus for winding generally cylindrical cross-wound yarn in reciprocating strokes, said apparatus including a first traverse device having a reciprocable yarn guide for guiding the yarn over the midrange of the strokes and a second traverse device embodying a rotatable driven cylindrical roller having a plurality of grooves for guiding the yarn at respective ends of the strokes in a program to impart stroke reversal to the yarn guided therein, said grooves having successive helical, reversal curve and helical portions in the surface of the roller, the improvement of which comprises: said helical portions occurring in a plurality of helix angles.

11. The apparatus as defined in claim 10, wherein the helix angles of at least a pair of successive strokes progress discontinuously.

* * * * *